United States Patent [19]

Warman et al.

[11] Patent Number: 4,544,090

[45] Date of Patent: Oct. 1, 1985

[54] ELASTOMERIC DRIVER RETURN ASSEMBLY FOR AN ELECTRO-MECHANICAL FASTENER DRIVING TOOL

[75] Inventors: Thomas E. Warman, Williamsburg; Gordon P. Baker, Amelia, both of Ohio; James E. Smith, Boulder, Colo.

[73] Assignee: Sencorp, Cincinnati, Ohio

[21] Appl. No.: 479,968

[22] Filed: Mar. 29, 1983

[51] Int. Cl.[4] ..... B25C 5/02; B25C 5/06; B25F 7/00

[52] U.S. Cl. ..... 227/131; 227/134

[58] Field of Search ..... 227/120, 131, 134; 74/89.2; 173/13, 140, 163

[56] References Cited

U.S. PATENT DOCUMENTS

| | | | |
|---|---|---|---|
| 3,695,215 | 10/1972 | Lambiris | 74/89.2 X |
| 4,042,036 | 8/1977 | Smith et al. | 227/131 X |
| 4,121,745 | 10/1978 | Smith et al. | 227/131 X |
| 4,189,080 | 2/1980 | Smith et al. | 227/131 X |
| 4,198,871 | 4/1980 | Dunn et al. | 74/89.2 X |
| 4,204,622 | 5/1980 | Smith et al. | 227/131 X |
| 4,231,190 | 11/1980 | Tieben | 74/89.2 X |
| 4,290,493 | 9/1981 | Smith et al. | 173/124 |
| 4,298,072 | 11/1981 | Baker et al. | 227/131 X |
| 4,323,127 | 4/1982 | Cunningham | 227/131 X |
| 4,366,722 | 1/1983 | Hasler | 74/89.2 X |

FOREIGN PATENT DOCUMENTS 0119822 9/1984 European Pat. Off. .

*Primary Examiner*—Paul A. Bell
*Assistant Examiner*—Taylor J. Ross
*Attorney, Agent, or Firm*—Frost & Jacobs

[57] ABSTRACT

A driver return assembly for an electro-mechanical fastener driving tool. The tool is of the type provided with a driver which is frictionally moved through a working stroke by means of an electrically driven flywheel which presses the driver against a support element, such as a counter rotating flywheel, a low inertia roller, or the like. The driver return assembly comprises at least one elastomeric cord being attached at one of its ends to the driver and at the other of its ends to an anchor within the tool. The at least one elastomeric cord, between its ends, passes about at least two pulleys. One of the pulleys is mounted on a spring supported shaft to compensate for stretch of the at least one elastomeric cord to assure that the driver is returned to its normal, retracted position after each working stroke.

12 Claims, 5 Drawing Figures

ELASTOMERIC DRIVER RETURN ASSEMBLY FOR AN ELECTRO-MECHANICAL FASTENER DRIVING TOOL

REFERENCE TO RELATED APPLICATION

The present invention is related to copending application Ser. No. 06/480/855, filed Mar. 31, 1983, in the names of Gordon P. Baker, James E. Smith and Thomas E. Warman, and entitled SPRING ACTUATED DRIVER RETURN ASSEMBLY FOR AN ELECTRO-MECHANICAL FASTENER DRIVING TOOL.

TECHNICAL FIELD

The invention relates to a driver return assembly for an electro-mechanical fastener driving tool, the return assembly being of the type utilizing at least one elastomeric cord, and more particularly to such a driver return assembly having means to compensate for permanent stretch of the elastomeric cord.

BACKGROUND ART

Pneumatically actuated fastener driving devices, such as nailers and staplers, have long been in use and are well known in the art. The use of such tools is advantageous because they can drive fasteners more rapidly and more precisely than can be accomplished manually. However, a disadvantage of such pneumatically actuated tools lies in the fact that they require the presence of a source of compressed air and long lengths of hose. Thus, a compressor must be provided at the job site. Furthermore, such tools are not normally suited for home use, since a source of compressed air is not normally present in the home.

Recently, there has been much interest in electrically powered nailers and staplers, requiring only a source of electrical energy. Electrical energy is always present at a construction site. Electrical energy is also readily available in the home, making such tools appropriate for the home market.

Prior art workers have devised many types of electro-mechanical fastener driving tools. For example, U.S. Pat. Nos. 4,042,036; 4,204,662; and 4,323,127 each teach an electro-mechanical impact tool wherein the driver is frictionally moved through a working stroke by means of two counter-rotating flywheels, each flywheel being provided by its own electric motor. U.S. Pat. No. 4,121,745 also teaches an electro-mechanical impact tool utilizing counter-rotating flywheels to frictionally move the driver through its working stroke. In this instance, however, one flywheel is directly driven by an electric motor, while the other flywheel is driven by the same electric motor through the agency of pulleys and an elastomeric belt or gear means.

U.S. Pat. Nos. 4,189,080 and 4,298,072 teach electro-mechanical fastener driving tools wherein the driver is moved through a working stroke by means of a single rotating, high-speed flywheel. The driver is engaged between the single flywheel and a support element. The preferred form of support element comprises a low inertia roller. Both patents teach, however, that other support means, such as a linear bearing or a Teflon block, could be used to accomplish the same purpose.

Electro-mechanical tools of the general class described above can be used to drive nails, staples or the like. For purposes of an exemplary showing, the present invention will be described in terms of its application to an electro-mechanical nailer. It will be understood by one skilled in the art, however, that the teaching of the present invention are equally applicable to electro-mechanical staple driving tools.

One of the many ways in which all such electro-mechanical fastener driving tools differ from their pneumatically actuated counterparts is the manner in which the driver is returned to its normal, unactuated position, having completed a working stroke. In a pneumatically actuated tool, the driver is most usually returned by compressed air, the driver being attached to a piston located in the main cylinder of the tool. In an electro-mechanical tool, on the other hand, alternate means must be provided to return the driver to its normal, unactuated position, having completed a work stroke. The driver return means most commonly used comprises one or more elastomeric cords affixed at one end to the upper end of the driver and at the other end to an anchoring means within the tool housing.

Such elastomeric return means are subject to permanent stretching. Permanent stretching of the elastomeric return means is the result of a number of factors, such as cyclic use, elevated temperatures within the tool, the surrounding atmosphere, the tendency of the elastomeric material to stretch or creep and aging of the material. Stretching of the elastomeric cord or cords can take place to the extent that the driver is not fully returned to its normal, unactuated position. This, in turn, can result in improper functioning of the electro-mechanical fastener driving tool. Traditionally, such electro-mechanical fastener driving tools have not been provided with take-up compensation means. As a result, when stretch of the elastomeric cord or cords has become too great for proper operation of the tool, it has hitherto been necessary to disassemble the tool and adjust or replace the elastomeric cord or cords.

The present invention is directed to a driver return assembly utilizing one or more elastomeric cords and provided with a spring-loaded tensioner to compensate for or take up stretch occurring in the elastomeric cords. This greatly increases the service life of the elastomeric cord or cords and improves the operation and reliability of the electro-mechanical fastener driving tool.

DISCLOSURE OF THE INVENTION

According to the invention, there is provided an improved driver return assembly for an electro-mechanical tool, such as a nailer or stapler. The tool is of the type having a driver which is frictionally moved through a working stroke by means of an electrically driven flywheel. The flywheel presses the driver against a support element. The support element may take the form of a second counter rotating driven flywheel, a low inertia roller, a linear bearing, or a Teflon block.

The electro-mechanical fastener driving tool is provided with a driver return assembly comprising at least one elastomeric cord. The cord is attached at one of its ends to the upper end of the driver and is affixed at its other end to an anchoring means within the tool housing. The at least one cord is caused to pass about at least two pulleys. One of the plurality of pulleys is spring mounted is such a way as to constitute a spring loaded tensioner to take up or compensate for stretch of the at least one elastomeric cord.

When more than one elastomeric cord is used in the return assembly, each cord is attached at one of its ends to the upper end of the driver and at the other of its ends to an anchoring means within the tool housing. Furthermore, a plurality of pulleys are provided for each cord, about which they pass. One of the pulleys of each cord is spring mounted so as to constitute a spring loaded tensioner.

BRIEF DESCRIPTION OF THE DRAWINGS

FIG. 3 is a fragmentary perspective view of a driver return assembly of the present invention.

DETAILED DESCRIPTION OF THE INVENTION

Figure 1:
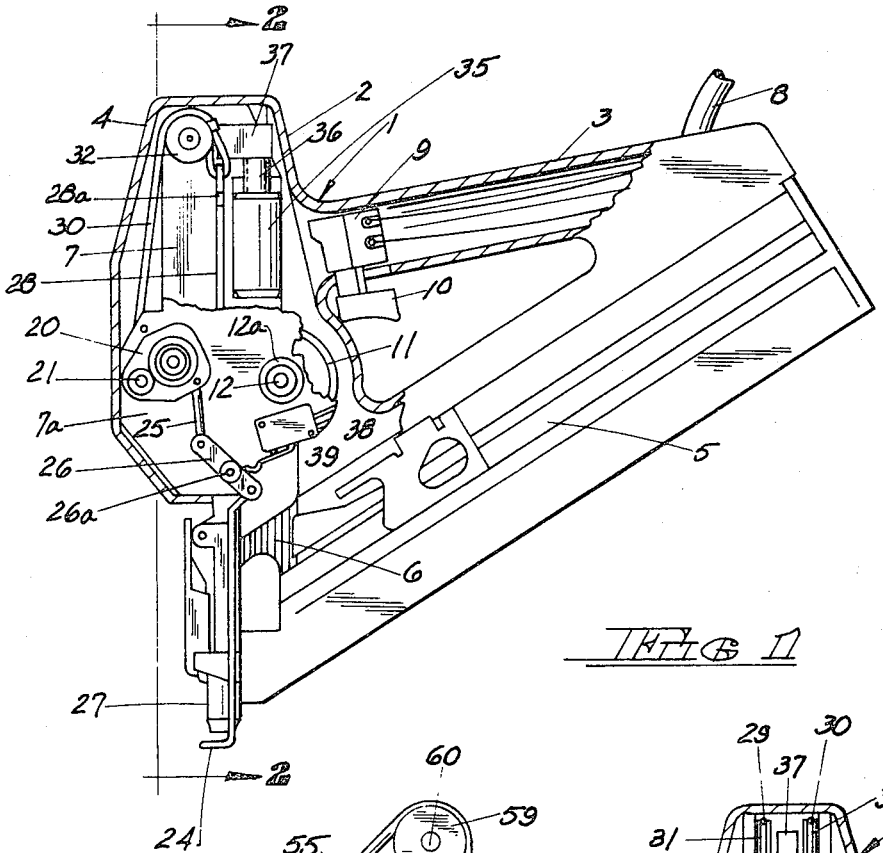
FIG. 1 is an elevational view, partly in cross section, illustrating an exemplary electro-mechanical fastener driving tool to which the teachings of the present invention can be applied.
Figure 2:
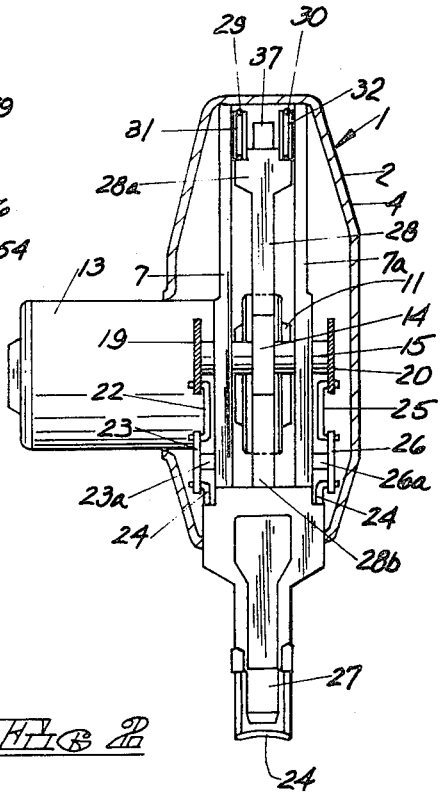
FIG. 2 is a cross sectional view taken along section line 2—2 of FIG. 1.

The teachings of the present invention are applicable to any electro-mechanical fastener driving tool of the type wherein the tool driver is moved through a working stroke by frictional engagement thereof with at least one rotating high speed flywheel. For purposes of a non-limiting, exemplary showing, the present invention will be described in terms of its application to an electro-mechanical nailer of the type described in the above noted U.S. Pat. No. 4,298,072. For a better understanding of this invention, the structure and operation of this exemplary tool will first be described. Reference is made to FIGS. 1 and 2, wherein like parts have been given like index numerals.

The tool is generally indicated at 1 and comprises a housing 2 having a handle portion 3, a main body portion 4, and a magazine portion 5. The magazine 5 contains a plurality of nails, some of which are shown at 6. The body portion 4 contains a pair of internal support plates 7 and 7*a* in parallel-spaced relationship.

The tool 1 is connectable to a source of electrical current (not shown) by an appropriate conductor 8. The handle portion 3 contains a switch 9 operated by a manual trigger 10.

The main body portion 4 contains a flywheel 11. The flywheel 11 is mounted on the shaft 12 of an electric motor 13, which shaft extends through bearings mounted in support plates 7 and 7*a*, one of which is shown at 12*a*.

A back-up means, in the form of a low inertia roller 14, is mounted on a shaft 15 supported between a pair of plates 19 and 20. The plates 19 and 20 are themselves pivotally affixed to a shaft 21 (see FIG. 1) rotatively mounted in support plates 7 and 7*a*. By vitrue of the pivotal mounting of plates 19 and 20, the back-up roller 11 is swingable toward and away from flywheel 11. To permit this, the shaft 15 of the low inertia roller 14 passes through elongated, arcuate slots in support plates 7 and 7*a*, with clearance.

The plate 19 is connected by link 22 to the forward end of a bell crank 23. The bell crank 23 is pivotally mounted on support plate 7 as at 23*a*. The rearward end of bell crank 23 is pivotally connected to the upper end of a workpiece responsive trip 24. In similar fashion, the plate 20 is pivotally connected by a link 25 to the forward end of a bell crank 26. The bell crank 26 is pivotally mounted on support plate 7*a* as at 26*a*. The rearward end of bell crank 26 is also pivotally affixed to the upper end of workpiece responsive trip 24.

It will be noted from FIGS. 1 and 2 that the workpiece responsive trip 24 normally extends below the nose portion 27 of tool 1. In fact, means (not shwon) are provided to bias the workpiece responsive trip 24 to its normal or lower position. When the tool 1 is brought to bear against a workpiece, with its nose portion 27 on the workpiece to be nailed, the workpiece responsive trip 24 will be shifted upwardly. This will cause bell cranks 23 and 26 to rotate (bell crank 26 rotating in a counterclockwise direction as viewed in FIG. 1). As a result of this rotation of the bell cranks, the links 22 and 25 will pull downwardly upon plates 19 and 20, causing them to rotate about their mounting shaft 21. Thus, plate 20 will rotate in a clockwise direction about its mounting shaft 21, as viewed in FIG. 1. When the plates 19 and 20 are in their normal positions shown in FIGS. 1 and 2, the low inertia back-up roller 14 will be in its normal position remote from flywheel 11. When the workpiece responsive trip 24 is depressed, rotation of plates 19 and 20 about their mounting shaft 21 will cause the low inertia back-up roller 14 to swing toward flywheel 11, to a position wherein the distance between the low inertia roller 14 and flywheel 11 is less than the thickness of the instrument driver.

The instrument driver is illustrated in FIGS. 1 and 2 at 28. The driver comprises an elongated planar member of uniform width, except at its upper end 28*a* which may be enlarged as shown, to give the driver a T-shaped configuration. The lower end 28*b* of the driver 28 is located in a channel or drive track in the nose portion 27 of nailer 1.

To maintain the driver 28 in its retracted or normal position when not being driven, a return mechanism is provided. A typical return mechanism is illustrated as comprising a pair of elastomeric cords 29 and 30. The cords 29 and 30 are tied, or otherwise fastened to the enlarged upper end 28*a* of driver 28. The elastomeric cords 29 and 30 pass over pulleys 31 and 32, respectively. The other ends of cords 29 and 30 are appropriately anchored by conventional means (not shown). In this way, the elastomeric cords will enable the driver to be driven downwardly (as viewed in FIGS. 1 and 2) to drive a nail into a workpiece, but will, upon release of the driver by the flywheel 11 and low inertia roller 14, return the driver to its normal position illustrated in FIGS. 1 and 2.

The driver 28 is of uniform thickness throughout its length, with the exception that it is provided with a transverse notch (not shown). It will be remembered that when the low inertia roller 14 is shifted toward flywheel 11 by the workpiece responsive trip 24, it will be spaced from the flywheel by a distance less than the thickness of the driver. The notch in driver 28 is so positioned on the driver as to lie opposite flywheel 11 when the driver is in its normal position illustrated in FIGS. 1 and 2. As a consequence, the low inertia roller 14 can be shifted to its active position adjacent flywheel 11 without causing the driver 28 to be advanced through its working stroke by the flywheel.

In order for the driver 28 to be driven by flywheel 11, it is necessary to shove the driver 28 downwardly (as viewed in FIGS. 1 and 2) until its portion of uniform thickness enters between flywheel 11 and low inertia roller 14 to be frictionally engaged thereby when the low inertia roller is in its active position. Either flywheel 11 or low inertia roller 14 is so mounted as to yield slightly to accommodate the normal thickness of the driver 28, while maintaining a frictional engagement between driver 28 and flywheel 11.

The downward movement of driver 28 is accomplished through the agency of a solenoid 35. Solenoid 35 has a core 36 provided with a laterally extending end piece 37 which overlies the enlarged end 28*a* of driver 28. Thus, when the solenoid 35 is energized, its core 36 and end piece 37 will move downwardly, forcing the driver 28 between flywheel 11 and low inertia roller 14, resulting in the driver being moved through its working stroke.

Solenoid 35 is actuated by manual trigger 10 and switch 9. In the same circuit, there is a safety switch 38 having a contact member 39. The circuit, including switch 9 and solenoid 35, cannot be closed by trigger 10 unless contact member 39 of safety switch 38 is in its closed position. The contact member 39 of switch 38 is shifted to its closed position by the rearward end of bell crank 26 when the workpiece responsive trip 24 is depressed against a workpiece.

It will be clear from the above description that when the nose 27 of tool 1 is pressed against the workpiece, the workpiece responsive trip 24 will shift upwardly pivoting bell crank 26. This accomplishes two purposes. First of all, it causes the low inertia roller 14 to shift toward the flywheel 11 to its active position. Simultaneously, the contact member 39 of safety switch 38 is closed, enabling the circuit containing trigger actuated switch 9 and solenoid 35. When the manual trigger 10 is depressed, the solenoid 35 will be actuated, resulting in the forcing of the driver 28 between flywheel 11 and low inertia roller 14, to cause the driver to be moved through its working stroke, driving a nail into the workpiece.

When the tool 1 is lifted from the workpiece, the workpiece responsive trip 24 will shift to its normal position illustrated in FIGS. 1 and 2, causing the low inertia roller 14 to pivot to its normal or retracted position. Safety switch contact member 39 will simultaneously be shifted to its off or open position returning the core 36 and end piece 37 of solenoid 35 to their normal positions, even if the trigger 10 is maintained closed by the operator. The elastomeric cords 29 and 30 wll return driver 28 to its normal position and the tool will be ready for its next cycle.

The use of elastomeric cords in the driver return assembly is a preferred approach because it is simple, inexpensive and quick-acting. As indicated above, however, the use of one or more elastomeric cords can produce a problem in that the cords are subject to permanent stretch. Permanent stretching of the cords can be caused by one or a combination of factors, such as cyclic use, stretch or creep of the cords, aging of the cords, the atmosphere to which the cords are subjected and the elevated temperatures they may encounter within the tool, generated by the frictional engagement of the driver by the flywheel. The elastomeric cords, such as cords 29 and 30, can stretch to the extent that the driver 28 is not fully returned to its retracted or normal position. This, in turn, can result in malfunctioning of the tool. For example, if the driver 28 is not returned to its fully retracted position so that its transverse notch lies opposite flywheel 11, the driver might be driven through its working stroke upon pressing of the workpiece responsive trip 24 against the workpiece, even though trigger 10 has not been actuated by the operator.

While stretch of the one or more elastomeric cords is a well known problem with electro-mechanical tools of the type described, prior art workers have not hitherto provided take-up or compensation means to accommodate for such stretch of the cord or cords.

FIG. 3 illustrates one embodiment of the spring loaded tensioner of the present invention. In FIG. 3, the pulleys 31 and 32, the elastomeric cords 29 and 30, and the driver 28 of FIGS. 1 and 2 are illustrated. The pulleys 31 and 32 are rotatively mounted on a shaft 40. The shaft 40 is supported by and between support plates 7 and 7*a* (see FIGS. 1 and 2).

The upper end 28*a* of driver 28 is provided with a pair of perforations 41 and 42. Elastomeric cord 29 passes through perforation 41 and is tied or clamped. For purposes of an exemplary illustration, the cord 29 is shown as being clamped by a clamp 43. In a similar fashion, cord 30 passes through driver perforation 42 and is clamped by a clamp 44. The other end of cord 30 is formed into a loop passing about a shaft 45 and is clamped by a clamp 46. It will be understood that the other end of cord 29 (not visible) will also be looped and pass about shaft 45, being tied or clamped thereabout. The shaft 45 is mounted in and between support plates 7 and 7*a* (see FIGS. 1 and 2), and constitutes an anchor for cords 29 and 30.

Cords 29 and 30 are also caused to pass about a pair of pulleys 47 and 48, respectively. Pulleys 47 and 48 constitute a second set of pulleys, rotatively mounted on a shaft 49.

A set of coiled tension springs 50 and 51 are provided. First ends of springs 50 and 51 are formed into hook-shaped configurations and are engaged about shaft 49. The first hooked end of spring 50 is not visible in FIG. 3, but the first hooked end of spring 51 is shown at 51*a*, the first hooked end of spring 50 being substantially identical. Springs 50 and 51 have second hook-shaped ends 50*b* and 51*b* which are engaged about a shaft 52. The shaft 52 is mounted in and between support plates 7 and 7*a* (see FIGS. 1 and 2) and constitutes an anchor for coil springs 50 and 51.

It will be evident from FIG. 3 that pulleys 47 and 48, pulley shaft 49, coil springs 50 and 51, and coil spring anchor shaft 52 constitute a spring loaded tensioner for cords 29 and 30 which will automatically compensate for stretch of these elastomeric cords. The pulley shaft 49 may be a free-floating shaft between the support plates 7 and 7*a* (see FIGS. 1 and 2) of tool 1. Alternatively, the ends of pulley shaft 49 may pass through elongated slots (not shown) in support plates 7 and 7*a*, the slots being so configured as to permit shiting of pulley shaft 49 to take up stretch in elastomeric cords 29 and 30 and to serve as a guide for any shifting of shaft 49.

It would be possible in the tool 1 of FIGS. 1 and 2 to provide a single elastomeric cord to cause return of driver 28 to its normal or retracted position after a work stroke. Minor modifications would have to be made in the tool 1. Turning to FIG. 2, when a single elastomeric cord is used, pulleys 31 and 32 would be eliminated and a single pulley substituted therefor and located centrally between support plates 7 and 7*a*. In order to make room for the single elastomeric cord and the single pulley, the end member 37 of solenoid core 36 would have to be modified, as by forming bifurcations thereon which would lie to either side of the single central pulley and would engage the ends of the enlarged upper portion 28*a* of driver 28.

Figure 4:
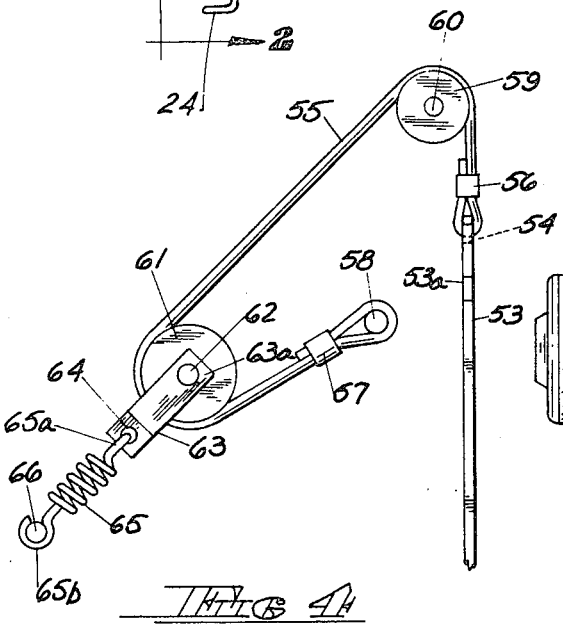
FIG. 4 is a fragmentary side elevational view of another embodiment of the driver return assembly of the present invention.

A single elastomeric cord driver return assembly of the present invention is illustrated in FIG. 4. In this embodiment, a driver 53 is shown, similar to driver 28 of FIGS. 1 and 2. The driver 53 has an enlarged end 53*a* provided with a perforation 54. An elastomeric cord 55 is provided, one end of which passes through the driver perforation 54 and is tied or clamped thereabout. In FIG. 4, a clamp is illustrated at 56. The other end of elastomeric cord 55 is formed into a loop maintained by clamp 57. The loop passes about a shaft 58. The shaft 58 would be mounted in and between support plates 7 and 7*a* (see FIG. 2) and would serve as an anchor for the elastomeric cord 55. A single pulley 59, similar to pulleys 30 and 32 of FIG. 2, is provided and is rotatively mounted on a shaft 60. The shaft 60 is affixed to and between support plates 7 and 7*a* and elastomeric cord 55 passes about pulley 59.

A second pulley 61 is rotatively mounted on a short shaft 62. The shaft 62 is engaged by a U-shaped member 63, one of the legs of which is shown at 63*a*. The other leg of element 63 lies to the other side of pulley 61, with shaft 62 passing therethrough.

The base portion of element 63 has a perforation 64 therethrough. A coiled tension spring 65 is provided. One end 65*a* of coil spring 65 is hook-shaped and passes through the perforation 64 of element 63. The other end 65*b* of spring 65 is also hook-shaped and engages a shaft 66 mounted in and between support plates 7 and 7*a* of tool 1. The shaft 66 constitutes an anchor for coil spring 65. Pulley 61, element 63, coil spring 65 and anchor shaft 66 constitute a spring loaded tensioner for cord 55, automatically taking up any stretch formed in the cord.

Figure 5:
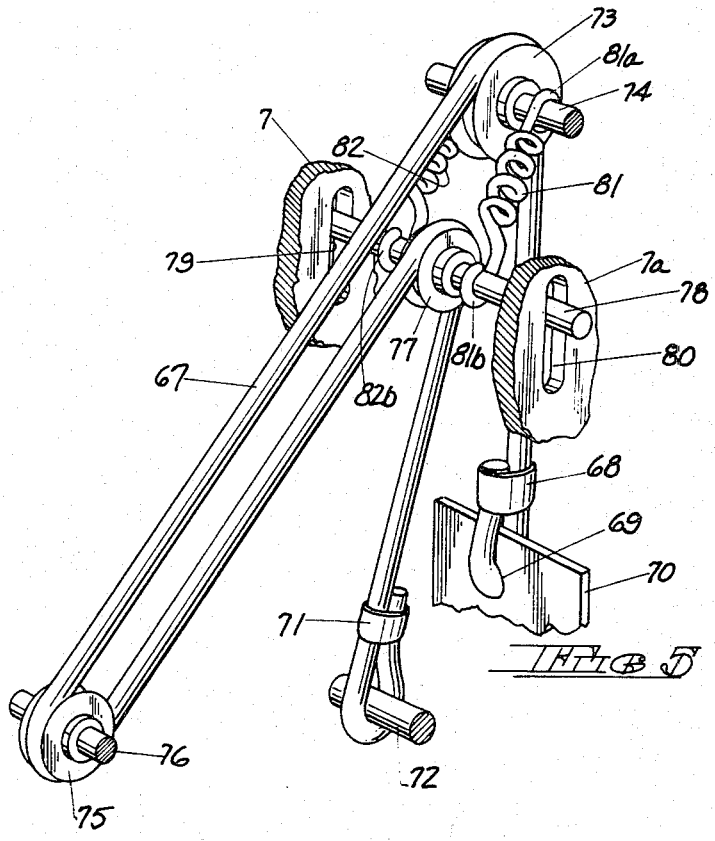
FIG. 5 is a fragmentary perspective view of yet another embodiment of the driver return assembly of the present invention.
Figure 5:
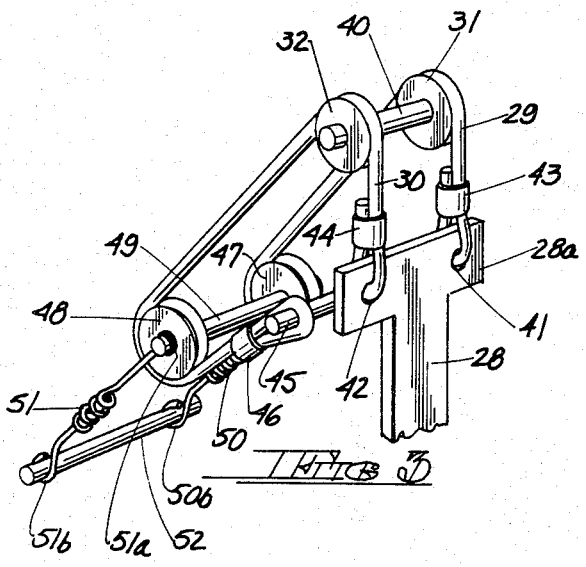

A three-pulley driver return assembly is illustrated in FIG. 5. The assembly of FIG. 5 again uses a single elastomeric cord 67. One end of cord 67 is formed into a loop by clamp 68 and passes through a perforation 69 in the upper end of a driver 70, equivalent to drivers 28 (FIGS. 1, 2 and 3) and 53 (FIG. 4). The other end of elastomeric cord 67 is maintained in a loop by clamp 71 and extends about a shaft 72. The shaft 72 is mounted in and between the support plates 7 and 7*a* (FIG. 2) of tool 1 and constitutes an anchor shaft for elastomeric cord 67.

Cord 67 passes about a first pulley 73 rotatively mounted on a shaft 74. The shaft 74 is mounted on and extends between support plates 7 and 7*a* of FIG. 2. Thereafter, elastomeric cord 67 passes about a second pulley 75 rotatively mounted on a shaft 76. Shaft 76 is also mounted on and extends between support plates 7 and 7*a* of tool 1. Finally, elastomeric cord 67 passes about a third pulley 77 rotatively mounted on a shaft 78. The ends of shaft 78 are slidably mounted in elongated slots 79 in support plate 7 and 80 in support plate 7*a*, permitting shifting of shaft 78 and serving as guides therefor.

A first coiled tension spring is shown at 81. One end 81*a* of coil spring 81 is hook-shaped and is engaged about shaft 74. The other end 81*b* of spring 81 is hook-shaped and engaged about shiftable shaft 78. A second coiled tension spring 82 is shown, located on the other side of pulleys 73 and 77. One end (not shown) of spring 82 is hook-shaped, similar to spring end 81*a*, and is engaged about shaft 74. The other end 82*b* of spring 82 is hook-shaped and is engaged about shiftable shaft 78. It will be evident that shaft 74 serves as an anchoring means and that springs 81 and 82 tend to urge shiftable shaft 78 upwardly in slots 79 and 80, as viewed in FIG. 5. As a result, pulley 77, shiftable shaft 78, shaft 74 and springs 74 and springs 81 and 82 constitute a spring loaded tensioner which will automatically compensate for stretch in cord 67.

It wll be understood by one skilled in the art that the driver return assembly of FIG. 5 could be readily adapted for use with two elastomeric cords. In such an instance, cord 67 and a second cord would be affixed at one of their ends to the driver 70 in the same manner described with respect to FIG. 3. Both elastomeric cords would be attached at their other ends to anchoring shaft 72. The only other necessary modification would be to provide shaft 74, shaft 76 and shiftable shaft 78 each with a second pulley to accommodate the second elastomeric cord. Springs 81 and 82 could be located either between or outside of the two pulleys mounted on each of shafts 74 and 78.

In all of the embodiments described above, slack or stretch in the return cord or cords will be automatically taken up without need for additional adjustment, replacement of the cords, or disassembly of the tool 1.

Modifications may be made in the invention without departing from the spirit of it.

What is claimed is:

1. In combination, a driver return assembly and an electromechanical fastener driving tool of the type having a driver, an electrically driven flywheel, together with a support element to engage said driver and move said driver through a working stroke, and at least one elastomeric cord affixed at one end to said driver and at the other end to a first anchoring means within said tool to return said driver to a normal retracted position after the working stroke, said driver return assembly comprising said at least one elastomeric cord and at least two rotatable pulleys over which said elastomeric cord passes, one of said pulleys being mounted on a fixed position shaft near that end of said driver to which said cord is affixed when said driver is in said normal retracted position, the other of said pulleys being mounted on a floating shaft spaced from said fixed position shaft, a second anchoring means within said tool, at least one tension spring, said floating shaft being connected to said second anchoring means by said at least one tension spring such that said pulley on said floating shaft applies tension to said elastomeric cord automatically, compensating for permanent stretch therein and assuring that said driver returns to its normal retracted position.

2. The structure claimed in claim 1 wherein said support element is a low inertia roller.

3. The structure claimed in claim 1 including guide means for said floating shaft.

4. The structure claimed in claim 1 including a U-shaped member having a pair of legs in parallel spaced relationship connected by a base portion, said floating shaft being mounted on said legs with said pulley thereon located between said legs, said tension spring being affixed at one end to said base portion and at the other end to said second anchoring means.

5. The structure claimed in claim 4 wherein said support element is a low inertial roller.

6. The structure claimed in claim 4 including guide means for said floating shaft.

7. The structure claimed in claim 1 including a plurality of elastomeric cords, one end of each of said cords being affixed to said driver and the other end of each of said cords being affixed to said first anchoring means within said tool, a plurality of pulleys being mounted on said fixed position shaft in spaced relationship, each of said cords passing about one of said last mentioned pulleys, a plurality of pulleys being mounted on said floating shaft in spaced relationship, each of said cords passing about one of said second mentioned pulleys, a pair of tension springs in spaced relationship, one end of each tension spring engaging said floating shaft, the other end of each of said tension springs engaging said second anchoring means within said tool.

8. The structure claimed in claim 7 wherein said support element is a low inertia roller.

9. The structure claimed in claim 6 including guide means for said floating shaft.

10. The structure claimed in claim 1 wherein said floating shaft is located near said fixed position shaft, and including a second fixed position shaft remote from said other shafts and having a pulley thereon, said elastomeric cord passing in order over said pulley on said first mentioned fixed position shaft, said pulley on said second fixed position shaft and said pulley on said floating shaft, a pair of tension springs, one end of each of said tension springs engaging said floating shaft on either side of said pulley thereon, the other end of each tension spring engaging said first mentioned fixed position shaft on either side of said pulley thereon.

11. The structure claimed in claim 10 wherein said support element is a low inertia roller.

12. The structure claimed in claim 10 including guide means for said floating shaft.

* * * * *